United States Patent [19]

Levene et al.

[11] Patent Number: 4,771,903

[45] Date of Patent: Sep. 20, 1988

[54] GLASS CONTAINER SEALING METHOD

[76] Inventors: Leon Levene, 35 Pheasant Valley Court, Thornhill, Ontario, Canada, L3T 2H2; Lawrence M. Verdonk, 36 Summertime Court, Brampton, Ontario, Canada, L6Z 2B4; Henry D. Todd, 2347 Cheverie Street, Oakville, Ontario, Canada, L6J 5W5

[21] Appl. No.: 930,460

[22] Filed: Nov. 14, 1986

[51] Int. Cl.[4] ..... B65B 51/14; B65B 7/28; B65D 51/20

[52] U.S. Cl. ..... 215/232; 215/305; 53/478; 53/485; 220/359; 156/69

[58] Field of Search ..... 215/31, 1 C, 232, 305; 220/359; 156/69; 53/478, 373, 317, 486, 485

[56] References Cited

U.S. PATENT DOCUMENTS

| | | | |
|---|---|---|---|
| 1,856,743 | 5/1932 | Brooks | 53/478 |
| 2,620,939 | 12/1952 | Weisgerber | 53/317 X |
| 2,860,801 | 11/1958 | Nielsen | 215/1 C |
| 2,937,481 | 5/1960 | Palmer | 53/478 X |
| 3,379,559 | 4/1968 | Gerhardt | 215/1 C |
| 3,460,310 | 8/1969 | Adcock et al. | 53/478 |
| 3,529,647 | 9/1970 | Ignell | 215/1 C X |
| 4,266,687 | 5/1981 | Cummings | 215/232 X |
| 4,345,412 | 8/1982 | Balzer et al. | 53/373 X |
| 4,396,655 | 8/1983 | Graham et al. | 215/232 X |
| 4,442,129 | 4/1984 | Niwa et al. | 53/478 X |

*Primary Examiner*—Horace M. Culver
*Attorney, Agent, or Firm*—Douglas N. Larson

[57] ABSTRACT

A process for hermetically sealing a glass container with contents therein is disclosed. The container has a mouth surrounded by a rim, at least a portion of the exterior surface, including the rim, of the container having a film coating of thermoplastic polymer thereon. The first step in sealing comprises substantially reducing the amount of contents' residue from the container rim. A closure is then applied to the rim. This closure is comprised of a layered material, having a thermoplastic polymer layer and a metallic layer, the thermoplastic layer contacting the thermoplastic polymer coating on the container rim. The thermoplastic polymer layer and the thermoplastic polymer coating consist essentially of mutually compatible polymeric materials. The closure is then heated in contact with the rim, to heat seal the closure to the rim coating and to seal the contents hermetically within the glass container.

20 Claims, 2 Drawing Sheets

GLASS CONTAINER SEALING METHOD

This invention relates to glass containers such as glass bottles, and methods for sealing the openings therein.

There is a need in the market place for a simple form of glass container seal which will give to the potential user of the contents of the container a clear indication that the original seal of the container's opening remains intact or has been broken. This is particularly important in respect to glass bottles containing foods, beverages, pharmaceuticals or other consumables, where the breaking of the original hermetic seal may indicate that the contents have been subjected to contamination, tampering or the like, with subsequent spoilage.

From the manufacturer's point of view however, any such seal must be economical and simple to manufacture and apply especially in cases where the consumable contents are of relatively low value, such as beverages, and the containers are intended to be throw away items.

One type of seal which shows potential for meeting these requirements is the membrane seal, where an appropriately sized and shaped membrane such as a metal foil closure is sealed across the container opening. A metal foil seal of this type is shown in U.S. Pat. No. 4,260,438 Dembicki et al, which describes the use of an aluminum foil-thermoplastic film laminate to seal and close the mouth of a glass jar or bottle. According to this patent, the thermoplastic layer of the film laminate (Surlyn, vinyl acetate or polyethylene) is heat welded, suitably by induction heating, to the rim of the glass bottle, and the glass/plastic bond so formed is rendered more durable by pre-treating the glass sealing surface at an elevated temperature with fluorine or a sulphur oxide, preferably in combination with a metal oxide, e.g. a tin oxide or a titanium oxide. The fluorine is applied by treating the glass surface with a fluorine-releasing compound at an elevated temperature at which fluorine is released from the compound in situ. Such an application process is, however, relatively expensive, since it requires a special bottle sealing surface treating step and a cooling step before the film laminate is applied by means of a subsequent heating step.

Commonly, glass bottles are subjected during manufacture to a hot end coating application and a cold end coating application. The hot end coating is applied when the bottle has just been formed and is still very hot (600°-800° C.). Materials such as tin tetrachloride and titanium tetrachloride are used, which form thin metal oxide films. The cold end coating is commonly applied to the entire exterior surface of the bottle, including the rim, after the coated bottle has been annealed and its surface temperature has dropped to about 100°-125° C. This is commonly a polymeric coating e.g. polyethylene or polystearate or a long chain aliphatic monomer such as oleic acid, and imparts lubricity to the surface of the body portion of the bottle.

Since glass bottles and jars with conventional hot end coatings and cold end coatings are produced commercially in very large quantities, and economically, it is highly desirable from a commercial point of view that any sealing process should be capable of being applied to such bottles and jars on a commercial scale and without requiring special modifications to the standard container making processes.

Many thermoplastic foil laminates or coated foils can be easily heat bonded to the rims of glass container mouths to provide very strong adhesion and a hermetic seal of the mouth, provided that the rim is clean and dry. The same applies when the rim carries a typical hot end coating, e.g. tin oxide. In fact, under certain sealing conditions, foil applied in such a way may have too strong a degree of adhesion to the glass, so that it will not readily peel off to provide access to the contents. In practice, however, such ideal conditions are not encountered in commercial beverage bottling lines. Of necessity, such lines are operated under conditions of high humidity, so that the bottle rim cannot be kept dry. Moreover, commercial beverage bottling lines operate at such high speeds, with so many co-ordinated high speed actions and manipulations, that accurate control of the filling liquid to keep the bottle rims free from liquid contamination is practically impossible. The presence of liquid on the bottle rim is likely to interfere with attempts to seal foils to the rim. This problem is particularly acute in the case of pulp containing liquids such as orange juice, grapefruit juice or tomato juice, where pulp is likely to contaminate the rim.

It is an object of the present invention to provide a process for hermetically sealing the mouths of glass containers which overcomes or at least substantially reduces one or more of the above disadvantages.

It is a further object of the invention to provide such a sealing process which is capable of being used on a commercial scale in conjunction with glass containers which have been produced using standard commercial manufacturing and coating techniques.

Accordingly, the present invention provides a process for hermetically sealing a glass container with contents therein, said container having a mouth surrounded by a rim, at least a portion of the exterior surface, including the rim, of said container having a film coating of thermoplastic polymer thereon, which comprises the successive steps of substantially reducing the amount of contents residue from the container rim; applying to said rim a closure, said closure being comprised of a layered material, having a thermoplastic polymer layer and a metallic layer, said thermoplastic polymer layer contacting the thermoplastic polymer coating on the container rim, said thermoplastic polymer layer and said thermoplastic polymer coating consisting essentially of mutually compatible polymeric materials; and heating said closure in contact with said film, to heat seal the closure to the rim coating and to seal the contents hermetically within the glass container.

It has been found that, provided the residue of contents resting on the container rim at the time of heat sealing, especially pulpy residues from materials such as orange juice, grapefruit juice, tomato juice and the like, is reduced below a certain level, and preferably substantially completely, a very effective heat seal can be formed, rapidly and with application of moderate heat and pressures, between layered materials having a metallic layer and a thermoplatic layer and thermoplastic coatings on the container rim, provided that the thermoplastics are mutually compatible. The thermoplastic coating on the container rim is preferably that applied as a cold end coating to the container during its production by conventional manufacturing processes as outlined above. Thus the present invention can be applied to commercially available mass-produced glass containers. The present invention also does not require any significant modification to the standard glass container manufacturing process, in which the glass containers are filled automatically and at high speed, for example 600 bottles per minute.

By "mutually compatible polymeric materials", as referred to herein, is meant pairs of polymeric materials which, upon melting in contact with one another, will fuse together with dispersion of each molten polymer into the other, so that on cooling and solidifying, a solid blend of the polymers has been formed. Preferably the polymeric materials used in the present invention show a very high degree of mutual compatibility, and most prefereably the thermoplastic polymer layer of the closure and the thermoplastic polymer coating on the container exterior and rim consist essentially of the same polymeric material.

The preferred thermoplastic polymer for use as the cold end coating material and the closure thermoplastic polymer layer is a polymer such as an ethylene-acrylic acid copolymer crosslinked by ionic bonds through a multi-valent metal ion, i.e. an ionomer. A well known example of such a material is Surlyn (manufactured by E. I. du Pont de Nemours & Co.), especially Surlyn 1702 and Surlyn 1705. Glass containers having cold-end coatings of such Surlyn-based materials are known and commercially available, e.g. from Domglas Inc. Suitable foil laminates of Surlyn-based materials and aluminum foil for use in the present invention are known and commercially available, the best of which is available from Tscheulin, West Germany. Such Surlyn based materials, in the present invention, provide hermetic seals with a desirable degree of strength to allow them to maintain their integrity over extended periods of time, but still allow simple manual peeling away to leave a rim substantially free from foil residues when the user desires access to the container's contents. Moreover, once removed or punctured, the seal utilizing Surlyn based materials cannot be simply replaced and re-sealed, so that it is adequately tamper-evident.

The closure is preferably a metal-thermoplastic polymer foil laminate and is most preferably a Surlyn-/aluminum foil laminate. Alternatively, the closure is made of a polymer sheet with a layer of metal vapour deposited thereon.

In a preferred embodiment of the present invention, the rim of the glass container is shaped to provide a substantial surface for sealing thereto of the closure, with a frustoconical surface portion and a planar annular portion integral therewith, and the closure is complementarily pre-shaped. Thus, from another aspect, the present invention provides a glass container having a moutn bounded by a rim, said rim having a frustoconical outer portion and a planar annular inner portion integral therewith, said rim being provided with a continuous coating film of thermoplastic polymer. The angle of the frustoconical surface to the planar annular portion is preferably from about 10° to about 20°. Such an angle is small enough to allow sufficient downward pressure to be applied to the rim of the container in an upright position to utilize heat sealing by a conduction heating process, and also oblique enough to avoid shearing of the foil when pressure is applied to it.

The coating thickness of the Surlyn-based material provided on the glass container is suitably in the range from about 0.1 microns to about 10 microns. The maximum thickness is not critical, and is dictated by economy rather than practical, technical limitations. The minimum thickness is such as to provide a reasonable quantity of material for imparting good lubricity to the glass and for heat seal to the subsequently applied laminate, in a continuous manner.

The thickness of the thermoplastic polymer layer of the closure is suitably from about 20 to about 80 microns. The thermoplastic layer is suitably laminated with aluminum foil 20–80 microns in thickness, to provide a reasonably durable, handleable but economical product or a thin film of metal, e.g. aluminum can be vapour deposited on the thermoplastic film.

There are several methods which can be adopted for substantially reducing contents residues from the coated rim, prior to effecting sealing of the foil laminate closure thereto. The primary purpose of this step is to prevent the interposition of residues from the contents with which the container is filled, especially pulpy residues, between the layers of thermoplastic polymer, since such substances will detract from the quality of the seal. Sealing under wet or humid conditions, however, with moisture present on either or both of the container rim and the thermoplastic polymer layer of the closure is not harmful to the quality of the seal, except under extreme circumstances. In many instances in the process of the invention, indeed the presence of some moisture on the surfaces to be sealed is beneficial. It leads to a closure which can readily be peeled off the mouth of the container, especially when Surlyn-based material is used, without leaving unsightly or sharp closure residues partially obstructing access to the container mouth, but still providing a satisfactory hermetic seal.

The consumable contents with which a glass container is commonly to be filled and subsequently hermetically sealed in a tamper-evident manner can be generally divided into three broad categories, namely dry materials (e.g. powder such as freeze dried coffee, milk powders, tea and the like), wet, non-pulpy materials such as apple juice and grape juice, and wet, pulpy materials such as orange juice, grapefruit juice, tomato juice and the like. The most acute container sealing problems are encountered in connection with wet, pulpy materials, for two basic reasons. Firstly, the presence of pulpy, semi-solid residues on the container rim after the filling process will seriously detract from the strength and effectiveness of the seal between the rim and the closure. Secondly, the container filling and sealing takes place whilst the contents are hot. As the sealed containers cool after the filling and sealing operation, sub-atmospheric pressure develops in the space above the contents, consequently exerting force on the newly applied seal with risk of rupturing it before it has fully formed. The problem of hermetic sealing of pulpy materials in a tamper-evident but economical manner has plagued the beverage bottling industry for many years.

The present invention overcomes or at least very substantially reduces these problems, in a simple and efficient manner, by adopting a procedure whereby the amount of pulpy residues left on the rim is reduced below a critical level, using a process which avoids physical contact with the rim after filling i.e. avoids mechanical wipes, and utilizing closure laminates having thermoplastic sealing layers compatible with the cold-end coating on the rim of the container and applying them to the rim under pressure and with conduction heating. The use of containers with the aforementioned rim shape is also highly advantageous. This allows the closure to be applied, under pressure, to seal both to the upper rim surface and to the frustoconical rim side surface, for a more efficient seal. By use of conduction heating under pressure, sealing can be effected at any or all parts of the closure-rim contact area, as desired, thereby conveniently allowing for the presence on the closure of a pull tab which is not to be sealed or bonded to the container. In contrast, if induction heating of the closure were to be adopted, the entire closure would be heated, including any side-protruding pull tab, with the result that sealing would be effected unselectively to the top surface of the container, and the pull tab would in all probability become sealed to the container side.

The sealing by conduction heating under pressure, according to the preferred procedure of the invention, works extremely effectively in the sealing of glass containers of hot, pulpy liquids such as orange juice, despite the fact that it applies even more heat to the already hot container and contents. The hermetic seal is formed quickly and strongly enough to resist the disruptive forces which are created on rapid cooling after sealing.

The sealing apparatus advantageously includes conductive, metal impregnated rubber gaskets in the sealing heads thereof. Each gasket contacts a preshaped laminated closure and is compressed against the closure during heating to ensure that the closure makes contact and adheres to the entire surface of the bottle rim. In this manner, channelling between the rim and closure due to microscopic surface roughness of the rim is reduced or obviated.

For reducing the amount of pulpy residue from the rim of the container prior to sealing, one can adopt a post heat treatment, in which at least the glass container rim with cold end coating thereon is heated. This heat treatment has the effect of rendering the rim surface more hydrophobic. Pulpy liquids and solids derived from the contents then have less tendency to stick to the container rim so that their residual quantity on the rim is substantially reduced. Moreover, they are then more readily squeezed out from between the two surfaces coming into contact during the sealing process.

An alternative and preferred method for substantially reducing contents residues from the rim prior to sealing is to subject the rim, after the contents have been deposited into the container, to a fluid stream directed across the surfaces of the rim. Suitably, the fluid stream is a steam jet applied through an array of nozzles directed at the bottle rim. It should be noted that physical wiping or brushing of the rim to remove pulpy residues should be avoided, since that can lead to contamination and is, in any event, less satisfactory for resulting in good hermetic seals.

In the commercial practice of the sealing process of the invention, the foil laminate closures are suitably formed by cutting and pressing the desired shapes from a roll of the laminate, on a forming press. The formed closures are then transported through a chute, from which they are placed on the cleaned rim of the filled container. The container carrying the closure then proceeds to a sealing station, where a heated sealing head is lowered onto the rim to heat and press the closure into hermetic sealing relationship on the container rim by conduction heating. Suitable temperatures when using the preferred Surlyn-based thermoplastic polymer are in the range 200°–250° C., with pressures in the range 30–60 psi. A dwell time of the sealing head on the bottle and closure assembly at these temperatures and pressures is suitably of the order of 1–2 seconds to provide an effective hermetic seal.

The use of Surlyn-based polymers as the thermoplastic sealing medium on both the glass container rim (cold end coat) and the closure laminate has another advantage, in addition to its sealing efficiency under conditions of high humidity and moisture presence on the surfaces to be sealed. This relates to the rapid speed with which the material develops a hermetic seal, after application of heat and pressure to bond the two surfaces together. This has very significant advantages in practice as outlined above. The pulp-containing liquids such as orange juice which give so much difficulty in forming effective seals are traditionally filled into glass containers at elevated temperatures, e.g. 90° C. Then the hermetic seal must be applied while the contents are still hot. Even more heat is applied by the conduction heating to seal the closure. On cooling, a partial vacuum inevitably develops within the space between the closure and the liquid surface, which has the effect of applying force to the hermetic seal of the closure. This force is developed relatively rapidly, after the closure is applied. Closures, according to the present invention, develop hermetic seals sufficiently rapidly and in sufficient strength to withstand the pressures formed on cooling the hot filled contents immediately after formation of the seal.

The invention will be further described, for illustrative purposes only and without limitation, with reference to the accompanying drawings which illustrate specific preferred embodiments of the invention.

In the drawings.

In the drawings, like reference numerals indicate like parts.

Figure 1:
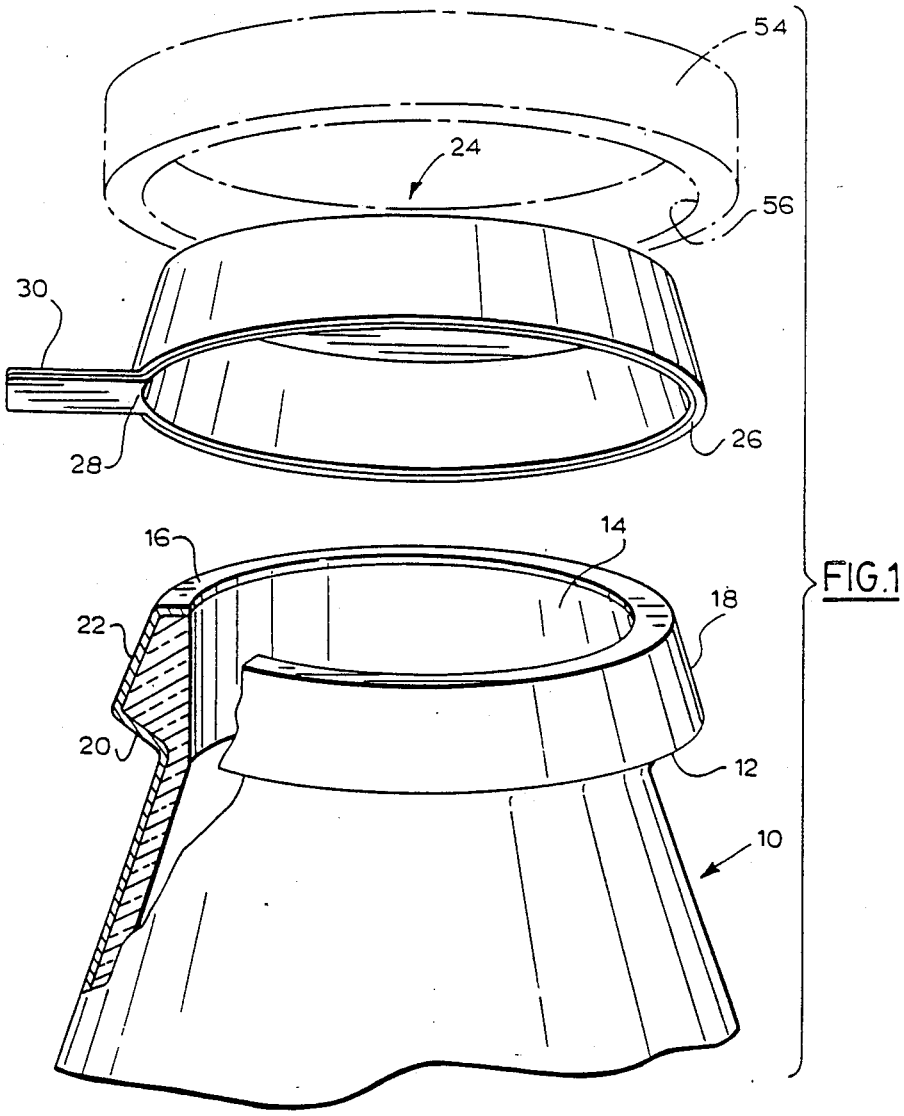
FIG. 1 is a diagrammatic view, partly in section, of a glass bottle rim and complementary laminated foil closure therefor.

With reference to FIG. 1 of the accompanying drawings, a glass bottle 10 is provided with a rim 12 surrounding an open mouth 14. The rim has an annular planar upper surface 16, and an integral outer frustoconical surface 18. The annular upper surface 16, the frustoconical surface 18 and the remainder of the exterior surface of the bottle are provided with a cold end coating 22 of Surlyn-based thermoplastic polymer material, of thickness within the range 0.1–10 microns.

There is provided a closure 24 for the bottle 10, consisting essentially of a laminate of an outer layer 26 of aluminum and an inner layer 28 of Surlyn-based material, of the same general chemical composition as that constituting the cold end coating 22 on the bottle rim. The closure 24 is shaped generally to complement and fit over the bottle rim 12. Thus it has a frustoconical side wall, the inner portion of which is constituted by the Surlyn-based layer 28 to contact the Surlyn-based coating 22 on the bottle rim, and a generally planar, upper surface, the periphery of which, at its inner, Surlyn laminated portion, will contact the annular upper surface 16 of the bottle rim. An integral pull tab 30 protrudes laterally from one side of the closure 24.

An aluminum-impregnated silicone rubber gasket 54 is shown in ghost outline above the closure in FIG. 1. This gasket is part of the sealing heads described hereafter. The lower face 56 of the gasket is shaped to complement the shape of the rim of the bottle 10.

Figure 2:
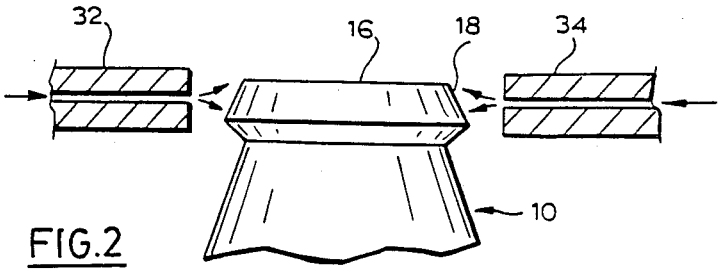
FIG. 2 is a diagrammatic illustration of a steam pipe arrangement for removing and/or diluting contents residues from the bottle rim prior to sealing.

Prior to applying the closure 24 to the bottle rim 12, in the process of the invention, the bottle 10 is filled with liquid contents through the mouth 14, as a result of which operation certain semi-solid, pulpy residues of the contents may deposit on the coated layer on the annular upper surface 16 or frustoconical surface 18 of the bottle. Such residues are removed or at least diluted below critical solids concentration by application thereto of steam jets, using an arrangement as shown in FIG. 2 of the accompanying drawings. In the arrangement illustrated, the bottle 10 with its coated frustoconical surface 18 and upper annular coated surface 16 passes between a pair of diametrically opposed steam jets 32, 34 from which steam under high velocity is directed at the upper rim of the bottle, so as to remove and/or dilute such content residues. A multiplicity of such jets may alternatively be used, arrayed around the rim of the bottle.

Figure 3:
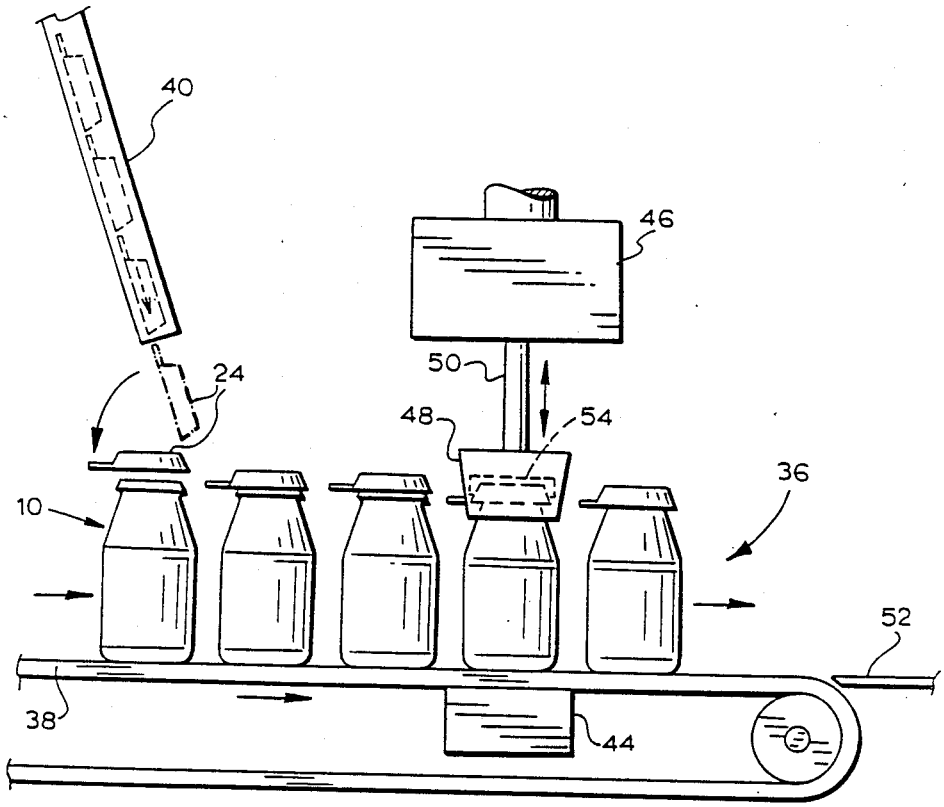
FIG. 3 is a diagrammatic illustration of a closure applying and sealing apparatus for use in the process of the present invention.

Next, the bottles 10 with cleaned upper rims 12 are fed to a closing and sealing apparatus 36, as shown diagrammatically in FIG. 3. The bottles 10 are fed by means of a conveyor 38 under a chute 40 which transports the closures to the bottles. One closure is arranged, by suitable triggered release mechanisms not shown, to be dropped from the chute 40 onto the top of the mouth 14 of each bottle 10. Then the bottle 10 is conveyed by conveyor 38 to a sealing station 42 which includes a lower support 44 under the conveyor, a fixed head 46 and a seal applying head 48 mounted on a piston 50 so as to be vertically reciprocable with respect to the fixed head 46. The seal applying head 48 is provided with a heated cavity with a gasket 54 therein. The gasket 54 is complementarily shaped to the closures 24 and the top of the bottle 10 as described heretofore. As a bottle 10 is placed above lower support 44 and under seal applying head 48, appropriate trigger mechanisms are operated so that the heated head is lowered and the gasket 54 is fitted over and compressed against the closure 24 to apply heat and pressure onto the closure 24 and heat seal it by conduction heating onto the top of the bottle. Then the seal applying head 48 is raised, and the bottle 10, with closure 24 now hermetically sealed in place, proceeds to take-off 52 and thence to cooling and to storage.

The illustrated arrangement is readily adapted to high speed commercial automated or semi-automated bottle filling lines, using switch and trigger arrangements and other apparatus modifications well known in the art. Thus, containers 10 pre-provided with Surlyn-based cold end coatings over their entire outer surface including rim surfaces 18 and 16 can be carried by a conveyor, through a work treating station comprising steam jets 32, 34, and thence to an automated version of apparatus 36. In actual commercial practice, a commercial machine may be equipped with a plurality of heated seal applying heads such as 48, arranged in a circular array and attached for reciprocation to a common, circular turret as fixed head 46. The turret is then revolvable about a vertical axis, so that a plurality of bottles 10 are sealed as the turret revolves, and are simultaneously conveyed by this turret around a circular path generally tangential to the conveyor 38, and then re-deposited on conveyor 38 after they have been sealed. Apparatus of this type, and useful in conducting the process of this invention, is available from Fords Barry-Wehmiller Ltd., Chantry Avenue, Kempston, Bedford MK42 7RS, England.

The invention will be further described with reference to the following specific examples, included for purposes of illustration only and not to be construed as limiting:

EXAMPLE 1

Control

A number of standard soda-lime glass containers (300 ml, flint) were made on a glass-forming machine under normal production conditions. The bottles had frustoconical and planar annular upper rim design as illustrated in FIG. 1. They were treated with a hot end coating of tin tetrachloride and an overall exterior cold end coating of FDA-approved Surlyn-based polymer dispersion, as supplied by Specialty Chemicals Inc., New Jersey.

Fifteen of these bottles were divided into three groups of 5 bottles each. Each bottle in each group was hot filled with water at 90° C. The rims of the second group were wetted with apple juice, a typical wet non-pulpy liquid. The rims of the third group were wetted with orange juice, a typical wet pulpy liquid. Nothing was applied to the rims of the first group of bottles.

Then, without any subsequent residue removal treatments, the bottles were sealed with laminated closures as illustrated in FIGS. 1 and 3, the closures consisting of laminated aluminum-Surlyn foil, aluminum thickness 40 microns, Surlyn thickness 50 microns (50 grams per square meter). The sealing took place at a sealing head temperature of 200° C., pressure 40 psi, dwell time 1.5 seconds. The containers were then allowed to cool, creating a vacuum in the space between the seal and the liquid surface, exerting a downward force on the seal. Cooling can take place slowly in air, or rapidly using a water spray.

Each bottle was then subjected to a subjective peel adhesion test. The same operator pulled the sealed closure off each bottle, carefully noting the adhesion over the area of finish as the closure was being removed. The resulting bottles were ranked on a scale of 0–10, a rating of 0–3 being referred to as exhibiting little to no adhesion, and not acceptable for the marketplace, a rating of 4–7 denoting 40–70% of the area exhibiting good adhesion, but still not acceptable, a rating of 8–9 denoting good adhesion over at least 90% of the available surface area, and being acceptable in the marketplace, and a rating of 10 being designated as perfect, with 100% adhesion on all areas at the finish, and market acceptable.

The group 1 bottles were ranked at 10 in this test. The group 2 bottles were ranked at 9.5. The group 3 bottles were ranked at 5. It is apparent from these test data that only poor seals are developed when liquid containing a large amount of pulp contaminates the bottle finish during the sealing process.

EXAMPLE 2

A further 15 glass containers prepared as described in Example 1 were divided into three groups of 5 bottles each. Each bottle was filled with hot water at 90° C., and subsequently the rims thereof were wetted with orange juice, a pulpy liquid, just prior to sealing as described in Example 1. The first group of 5 bottles were sealed as received. The second group of 5 bottles were subjected to a steam treatment as illustrated in FIG. 2, immediately prior to sealing. The third group of bottles were subjected to a heat treatment at 150° C. for 10 minutes prior to filling. Care was taken to keep the fill levels (head space) the same in all containers. The sealed containers were allowed to cool, and were then subjected to the peel adhesion test as described in Example 1.

On this test, the first group of bottles was rated at 2, poor. The second group of bottles, which received the steam treatment, was rated at 10, very good. The third group of bottles, which received the post-heat treatment, was rated at 10, very good. The data illustrates that steam or post-heat treatment dramatically improves the adhesion of the closures to the container rims.

In addition, this same test gave identical results when the bottles were filled with hot orange juice (90° C.) instead of hot water.

EXAMPLE 3

The procedures of Example 2 were essentially repeated, using groups of glass containers which had received a standard polyethylene cold end coating, extending over the rims thereof in the usual way. The bottles were treated and sealed under identical conditions as described in Example 2.

The bottles which received no treatment were rated, in the peel adhesion test, at 1, very poor. The bottles which received the steam treatment were rated at 8, marginally acceptable. The bottles which received post-heat treatment were rated at 8, marginally acceptable.

approximately the same as the pressure inside the bottle and gives an approximate reading of the vacuum within the bottle. The pressure in the vacuum chamber was then increased until the closure popped in, and the pop out and pop in values thus determined were recorded.

Five of the bottles from each of the three different groups were then placed in a humidity chamber, maintained at 98% humidity and 50° C. These bottles were periodically removed from the chamber, and their pop-out/pop-in values determined using the vacuum chamber as previously described.

The remaining 5 bottles from each of these groups were stored in the laboratory at room temperature during this test. These bottles were subjected to the same vacuum testing to determine pop out and pop in values as the humidity chamber treated containers. At the conclusion of a 14 day test period, the lids were peeled and adhesion strength given the subjective rating previously described. The results are presented in Table 1.

The data indicates that the vacuum maintained within the bottles and the eventual peel strength of the sealed containers, is essentially unaffected by the extreme humidity and temperature conditions. An effective, durable, hermetic seal has been developed on each bottle, but nevertheless the seals are relatively easily peelable.

TABLE 1

| | HUMIDITY CHAMBER | | | | | | ROOM STORAGE | | | | | |
|---|---|---|---|---|---|---|---|---|---|---|---|---|
| | DRY | | WET | (NON-PULP) | WET | (PULP) | DRY | | WET | (NON-PULP) | WET | (PULP) |
| DAY | ↑ | ↓ | ↑ | ↓ | ↑ | ↓ | ↑ | ↓ | ↑ | ↓ | ↑ | ↓ |
| 0 | 20 | 15 | 20.4 | 15.2 | 23.2 | 17 | 19.9 | 14.6 | 21.6 | 16 | 23.4 | 17.2 |
| 3 | 22.2 | 14.8 | 22.6 | 15.6 | 24 | 18 | 20.8 | 14.8 | 22.2 | 16.4 | 23.6 | 18.4 |
| 6 | 22 | 14.8 | 23.4 | 15.6 | 23.8 | 18.4 | 21.4 | 14.2 | 24.2 | 15.8 | 23 | 18.4 |
| 14 | 22.6 | 14.6 | 24.6 | 15.2 | 22.4 | 15.2 | 21.4 | 14.4 | 24 | 16 | 23.2 | 18.2 |
| PEEL VALUE (AFTER 14 DAYS) AVERAGE | | 10 | | 10 | | 9 | | 10 | | 10 | | 10 |

↑ POP-OUT (AVERAGE)
↓ POP-IN (AVERAGE)

This data also demonstrates the improvements in adhesion achievable when steam or post-heat treatments are used prior to sealing, but also demonstrates that polyethylene is an inferior thermoplastic sealing medium to Surlyn.

EXAMPLE 4

Thirty soda-lime glass containers with rim designs as illustrated in FIG. 1 (300 ml, flint) were hot end coated with tin tetrachloride to form a tin oxide coating, and cold end coated with Surlyn-based material over its entire outer surface. The bottles were filled with hot water and sealed as previously described in the previous examples. The first group of 10 bottles was sealed without any application of substances to the upper rims. The second group of 10 bottles was rim treated with apple juice, and then subjected to steam jets immediately prior to sealing. The third group of 10 bottles was rim treated with pulpy orange juice and then treated with steam jets immediately prior to sealing. The sealed bottles were all allowed to cool to room temperature, with the result that vacuum developed in the head space above the contents, and the laminated foil seals popped inwardly towards the bottle interior.

Each bottle was placed into a vacuum chamber, which was evacuated until the closure popped out. The pressure in the vacuum chamber when this occurs is

We claim:

1. A process for hermetically sealing a glass container, with contents therein, said container having a mouth surrounded by a rim comprising a frustoconical outer portion and a planar annular inner portion, said rim being provided thereon with a continuous coating of thermoplastic polymer constituting a part of the cold end coating conventionally applied to the exterior surface of the glass container, which comprises the successive steps of:

filling the glass container with contents;

subjecting the rim of the filled container to a fluid jet directed across the rim so as substantially to reduce the amount of contents residue on the container rim;

applying to said rim a closure of complementary shape therewith, said closure being comprised of a layered material having a thermoplastic polymer layer and a metal layer, said thermoplastic polymer layer contacting the thermoplastic polymer coating on the container rim, said thermoplastic polymer layer and said thermoplastic polymer coating consisting essentially of mutually compatible polymeric material;

and heating said closure in contact with the polymer coating on both the planar annular portion and the frustoconical portion of the rim, by conduction heating under pressure, to heat seal the closure to the cold end coating on the rim and to seal the contents hermetically within the glass container.

2. The process of claim 1 wherein the closure is a metal-thermoplastic polymer foil laminate.

3. The process of claim 2 wherein said metal is aluminum.

4. The process of claim 1 wherein the thermoplastic portion of the closure and the thermoplastic coating on the container both comprise of substantially the same thermoplastic polymer material.

5. The process of claim 4 wherein said thermoplastic polymer material is an ionomer.

6. The process of claim 1 wherein the contents deposited into the container comprise a liquid beverage.

7. The process of claim 6 wherein the liquid beverage is a wet pulpy liquid, and said liquid is hot at the time heat sealing of the closure is effected.

8. The process of claim 1 wherein a resilient gasket complementary in shape to said rim is compressed against said closure during heat sealing.

9. The process of claim 8 wherein said gasket is an aluminum impregnated silicone rubber gasket.

10. The process of claim 1 wherein said fluid jet is a steam jet.

11. The process of claim 1 wherein said closure is made of a layered material comprising a sheet of thermoplastic material with a layer of metal vapour-deposited thereon.

12. The process of claim 1 wherein said closure includes a laterally protruding pull-tab which is free from sealing engagement with the container.

13. A hermetically sealed glass container comprising, in combination, a glass container having a mouth bounded by a rim, said rim having a frustoconical outer portion and a planar annular inner portion integral therewith, both portions of said rim being provided with a continuous coating film of thermoplastic polymer firmly adhering thereto and constituting a part of the cold end coating conventionally applied to the exterior surface of the glass container, liquid contents inside said container, and a complementarily-shaped closure comprising a layered material with a metal layer and a thermoplastic polymer layer, said thermoplastic polymer layer being heat sealed to the thermoplastic polymer cold end coating on the rim of said container, to provide a hermetic seal for said container, the thermoplastic polymer coating on the container rim and the thermoplastic polymer layer consisting essentially of mutually compatible polymeric materials.

14. The container and closure combinaton of claim 13 wherein the thermoplastic polymer coating on the container rim and the thermoplastic polymer layer of the closure consist essentially of the same thermoplastic polymeric material.

15. The combination of claim 14 wherein said thermoplastic polymer material is a thermoplastic ionomer.

16. The combination of claim 15 wherein the liquid contents comprise a pulpy liquid beverage hermetically sealed within said container.

17. The combination of claim 16 wherein the head space between the liquid beverage and the closure is at reduced pressure.

18. The combination of claim 15 wherein said closure is provided with a laterally extending pull tab to facilitate peeling off of the closure from the container rim.

19. The combination of claim 13 wherein said closure is a metal-thermoplastic polymer foil laminate.

20. The combination of claim 13 wherein said closure is made of a layered material comprising a sheet of thermoplastic material with a layer of metal vapour-deposited thereon.

* * * * *